US007252156B2

(12) United States Patent
Sugiyama et al.

(10) Patent No.: US 7,252,156 B2
(45) Date of Patent: Aug. 7, 2007

(54) VIBRATION ISOLATION HANDLE

(75) Inventors: Yoshio Sugiyama, Anjo (JP); Sadaharu Oki, Anjo (JP); Kenichi Kawai, Anjo (JP); Hirokazu Kimata, Anjo (JP); Shinsuke Okuda, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/389,239

(22) Filed: Mar. 27, 2006

(65) Prior Publication Data

US 2006/0219419 A1 Oct. 5, 2006

(30) Foreign Application Priority Data

Mar. 31, 2005 (JP) ..... 2005-103691
Apr. 12, 2005 (JP) ..... 2005-114833

(51) Int. Cl.
*B25G 1/00* (2006.01)
*B25D 17/04* (2006.01)

(52) U.S. Cl. ..... 173/162.1; 173/162.2

(58) Field of Classification Search ..... 173/162.2, 173/162.1; 16/431, 224
See application file for complete search history.

(56) References Cited

U.S. PATENT DOCUMENTS

| | | | | |
|---|---|---|---|---|
| 5,157,807 | A * | 10/1992 | Keller et al. | 16/431 |
| 5,170,532 | A | 12/1992 | Holmin et al. | |
| 5,365,637 | A | 11/1994 | Bodell et al. | |
| 5,881,822 | A * | 3/1999 | Sienkiewycz et al. | 173/162.2 |
| RE37,190 | E * | 5/2001 | Stowell et al. | 16/422 |
| 6,241,594 | B1 * | 6/2001 | Lepold | 451/359 |
| D447,032 | S * | 8/2001 | Schoen et al. | D8/67 |
| D467,484 | S * | 12/2002 | Schoen et al. | D8/70 |
| D492,177 | S * | 6/2004 | Wright et al. | D8/70 |
| 6,863,479 | B2 * | 3/2005 | Frauhammer et al. | 408/241 R |
| 7,137,542 | B2 * | 11/2006 | Oki et al. | 173/162.2 |
| 2001/0011846 | A1 | 8/2001 | Krondorfer et al. | |
| 2002/0197939 | A1 * | 12/2002 | Frauhammer et al. | 451/64 |
| 2004/0013486 | A1 | 1/2004 | Cooper | |
| 2004/0016082 | A1 | 1/2004 | Yi | |

FOREIGN PATENT DOCUMENTS

| | | | |
|---|---|---|---|
| DE | 90 04 091 | U1 | 6/1990 |
| DE | 90 03 365 | U1 | 7/1991 |
| DE | 101 26 491 | A1 | 12/2002 |
| DE | 102 10 032 | C1 | 6/2003 |
| EP | 0 156 387 | A | 10/1985 |
| EP | 0 490 850 | A | 6/1992 |
| EP | 1 358 968 | A1 | 11/2003 |
| EP | 1 382 420 | A | 1/2004 |
| EP | 1 462 222 | A | 9/2004 |
| GB | 2 080 919 | A | 2/1982 |
| JP | Y 61-6343 | | 2/1986 |
| JP | A 2001-088059 | | 4/2001 |
| JP | A 2004-249430 | | 9/2004 |
| WO | WO 03/043785 | A1 | 5/2003 |

* cited by examiner

*Primary Examiner*—Brian D. Nash
(74) *Attorney, Agent, or Firm*—Oliff & Berridge, PLC

(57) ABSTRACT

It is an object of the invention to provide an effective technique for reducing the manufacturing costs of a handle mounted to a power tool. According to the invention, a representative handle may comprise a handle body, a grip, an elastic element and an elastic outer surface member. The grip is hollow-shaped and the handle body is inserted into the grip. The elastic element is disposed between the inner surface of the grip and the outer surface of the handle body to apply a biasing force to the grip upon movement of the grip with respect to the handle body when vibration of the power tool is transmitted from the handle body to the grip. The elastic outer surface member covers the outer surface of the grip. The elastic outer surface member is integrally formed with the elastic element. As a result, the manufacturing costs can be reduced compared with known construction in which the elastic outer surface member and the elastic element are separately formed.

14 Claims, 5 Drawing Sheets

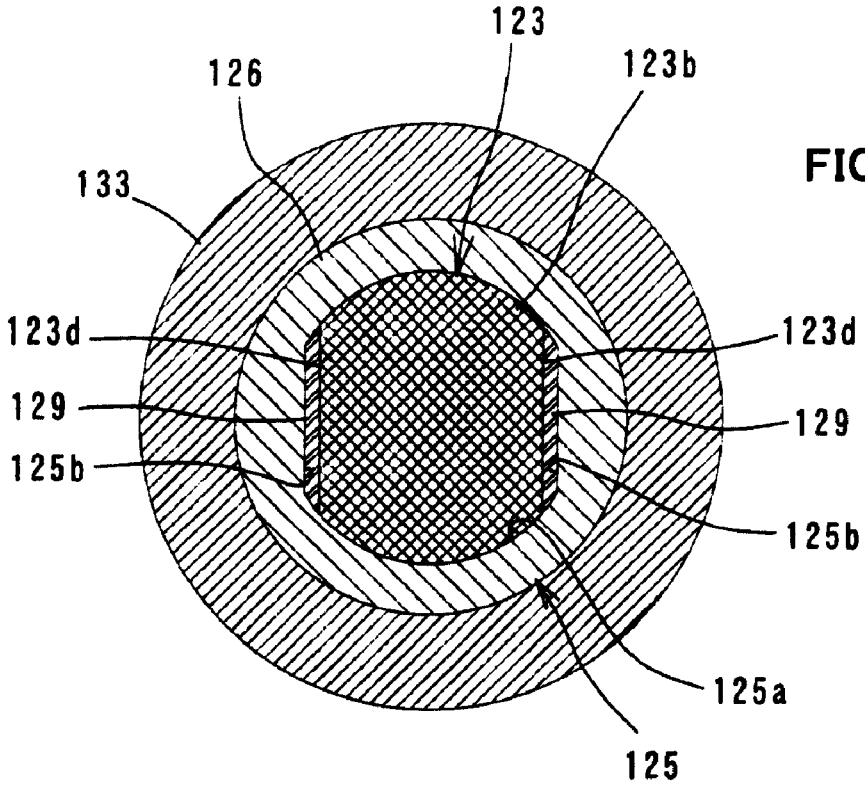
FIG. 3
FIG. 4
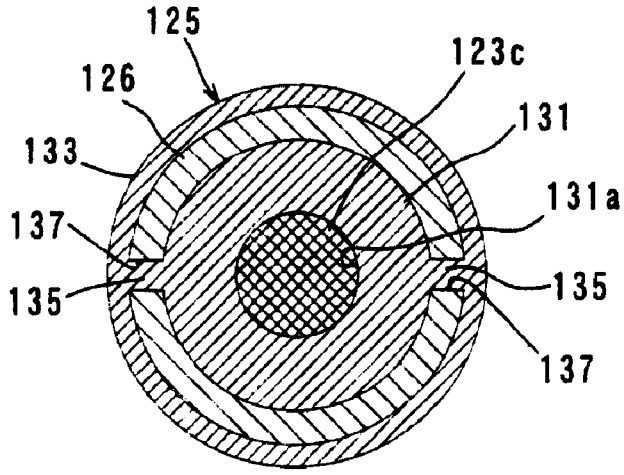

VIBRATION ISOLATION HANDLE

BACKGROUND OF THE INVENTION

1. Field of the Invention

The present invention relates to a handle which is removably mounted to a power tool and used to operate the power tool.

2. Description of the Related Art

Japanese non-examined laid-open Utility Patent Publication No. 2004-249430 discloses an auxiliary handle mounted to a body of an electric disc grinder and used to operate the disc grinder for grinding a workpiece. The known auxiliary handle includes a handle body fixedly mounted to the body of the electric disc grinder and a grip coupled to the handle body. The outer surface of the grip is covered with a non-slip rubber cover. A rubber isolator is disposed between the handle body and the grip and serves as vibration-proofing elastic element that applies a biasing force to the grip when the grip rotates with respect to the handle body. Besides such typical construction of the handle for a power tool, it is desired to seek for cost-effective rational structure of the handle for the power tool.

SUMMARY OF THE INVENTION

Accordingly, it is an object of the invention to provide an effective technique for reducing the manufacturing costs of a handle mounted to a power tool.

According to the invention, a representative handle may comprise a handle body, a grip, an elastic element and an elastic outer surface member. The handle body can be mounted to a power tool. The grip is hollow-shaped and the handle body is inserted into the grip. The grip is coupled to the impute handle body such that the grip can move with respect to the handle body. The elastic element is disposed between the inner surface of the grip and the outer surface of the handle body. The elastic element applies a biasing force to the grip upon movement of the grip with respect to the handle body when vibration of the power tool is transmitted from the handle body to the grip. The elastic outer surface member covers the outer surface of the grip. The "handle" according to the invention can be suitably applied to a rotary power tool such as a grinder and a polisher, which performs grinding or polishing operation on a workpiece by rotating a disc. Further, the representative handle can also be applied to an impact power tool such as an electric hammer or hammer drill, which performs fracturing or drilling operation on a workpiece by causing a tool bit to perform hammering movement in the axial direction or hammering movement and rotation in combination. Moreover, the representative handle can also be applied to cutting tools such as a reciprocating saw or a jig saw, which perform a cutting operation on a workpiece by causing a blade to perform a reciprocating movement, whereby causing a generally linear vibration.

As the specific manner of the grip that can move to the handle body, the grip may move linearly and in parallel to the handle body, the grip may rotate on one pivot, the grip may rotate on a plurality of pivots which cross each other or the grip may rotate on a spherical surface. The "elastic element" typically comprises a rubber or elastic resin. Further, as the specific manner of the elastic outer surface member that covets the outer surface of the grip, any one of covering part of the outer surface and covering the entire outer surface may be selected.

According to the representative invention, the elastic outer surface member that covers the outer surface of the grip is integrally formed with the elastic element disposed between the inner surface of the grip and the outer surface of the handle body. The elastic outer surface member and the elastic element may preferably be formed into one piece by using a mold. In this case, the method of insert molding may preferably be used. Specifically, a cylindrical member that forms the grip is placed in a mold in advance and then, the mold is charged with a liquid elastic material. The elastic outer member and the elastic element may preferably be formed into one piece by solidification of the liquid elastic material. As an alternative method, the elastic outer surface member and the elastic element may be formed into one piece by using a mold and then mounted to the cylindrical member that forms the grip.

According to the invention the elastic outer surface member disposed outside the grip and the elastic element disposed inside the grip are formed into one piece and thus forms one part. As a result, the manufacturing costs can be reduced compared with known construction in which the elastic outer surface member and the elastic element are separately formed.

Further, the representative handle may preferably be selectively mounted to different kinds of power tools and the natural frequency of the grip may preferably be changed in relation to the kind of power tool to which the handle is mounted. The "kinds of power tool" include the case in which power tools are different in model and the case in which power tools are of the same model, but different in type. In order to change the natural frequency of the grip, typically, a weight mounting portion may be provided in the grip and one of the weights of varying weight is selectively mounted in the weight mounting portion. For example, a plurality of weights of varying weight are prepared and a weight to be mounted in the grip is selectively changed between the case in which the vibration-proof handle is mounted to an impact power tool such as an electric hammer or hammer drill, and the case in which it is mounted to a cutting tool such as a reciprocating saw or a jig saw. In this case, a weight to be mounted in the grip may be selected either by the manufacture or the user.

Other objects, features and advantages of the present invention will be readily understand after reading the following detailed description together with the accompanying drawings and the claims.

BRIEF DESCRIPTION OF THE DRAWINGS

FIG. 3 is a sectional view taken along line III-III in FIG. 2.

FIG. 4 is a sectional view taken along line IV-IV in FIG. 2.

DETAILED DESCRIPTION THE OF INVENTION

Figure 1:
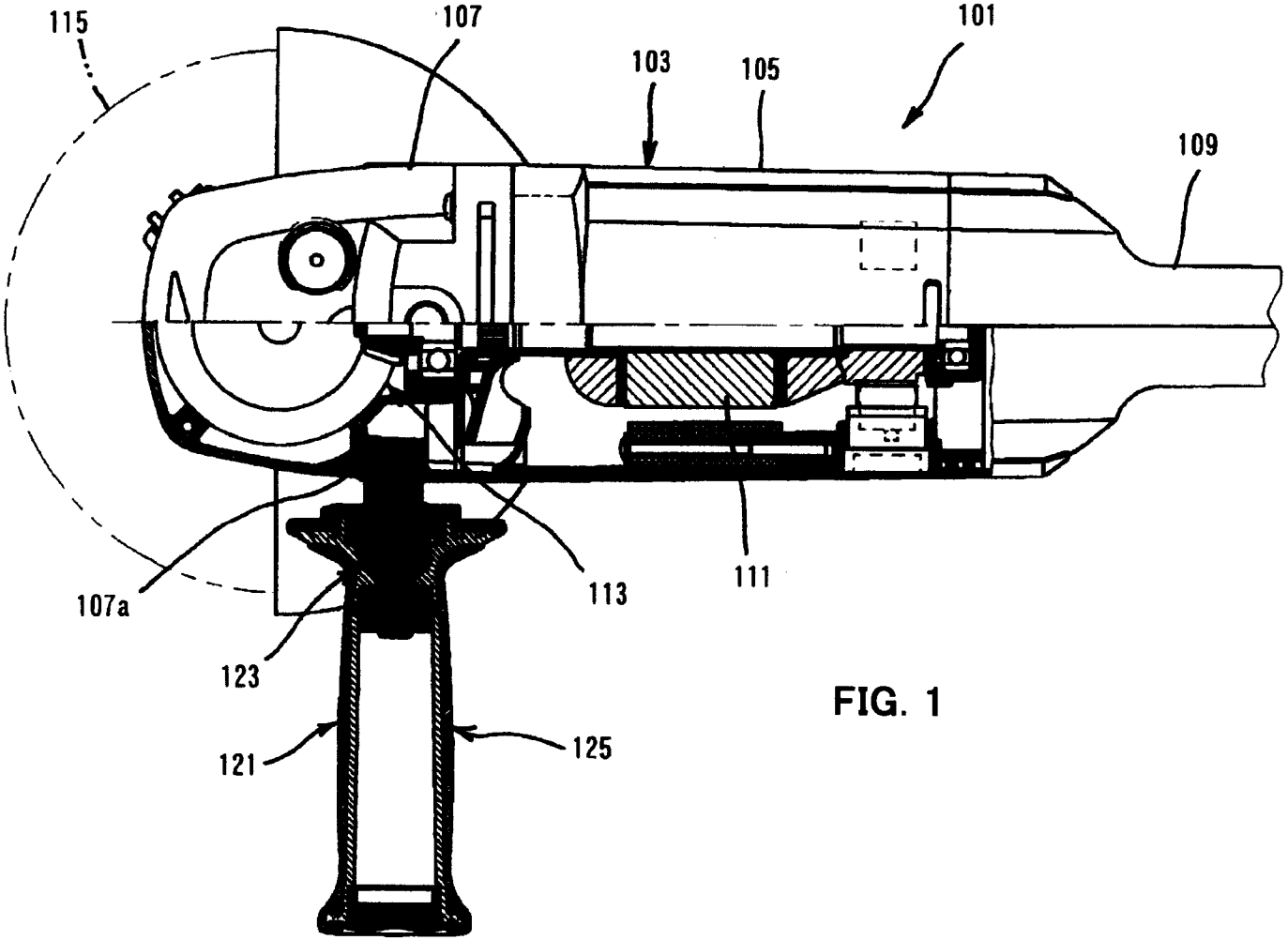
FIG. 1 is a plan view, partially in section, showing an entire electric disc grinder having an auxiliary handle according to an embodiment of the invention

Each of the additional features and method steps disclosed above and below may be utilized separately or in conjunction with other features and method steps to provide and manufacture improved handles and method for using such handles and devices utilized therein. Representative examples of the present invention, which examples utilized many of these additional features and method steps in conjunction, will now be described in detail with reference to the drawing. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIRST EMBODIMENT

Figure 2:
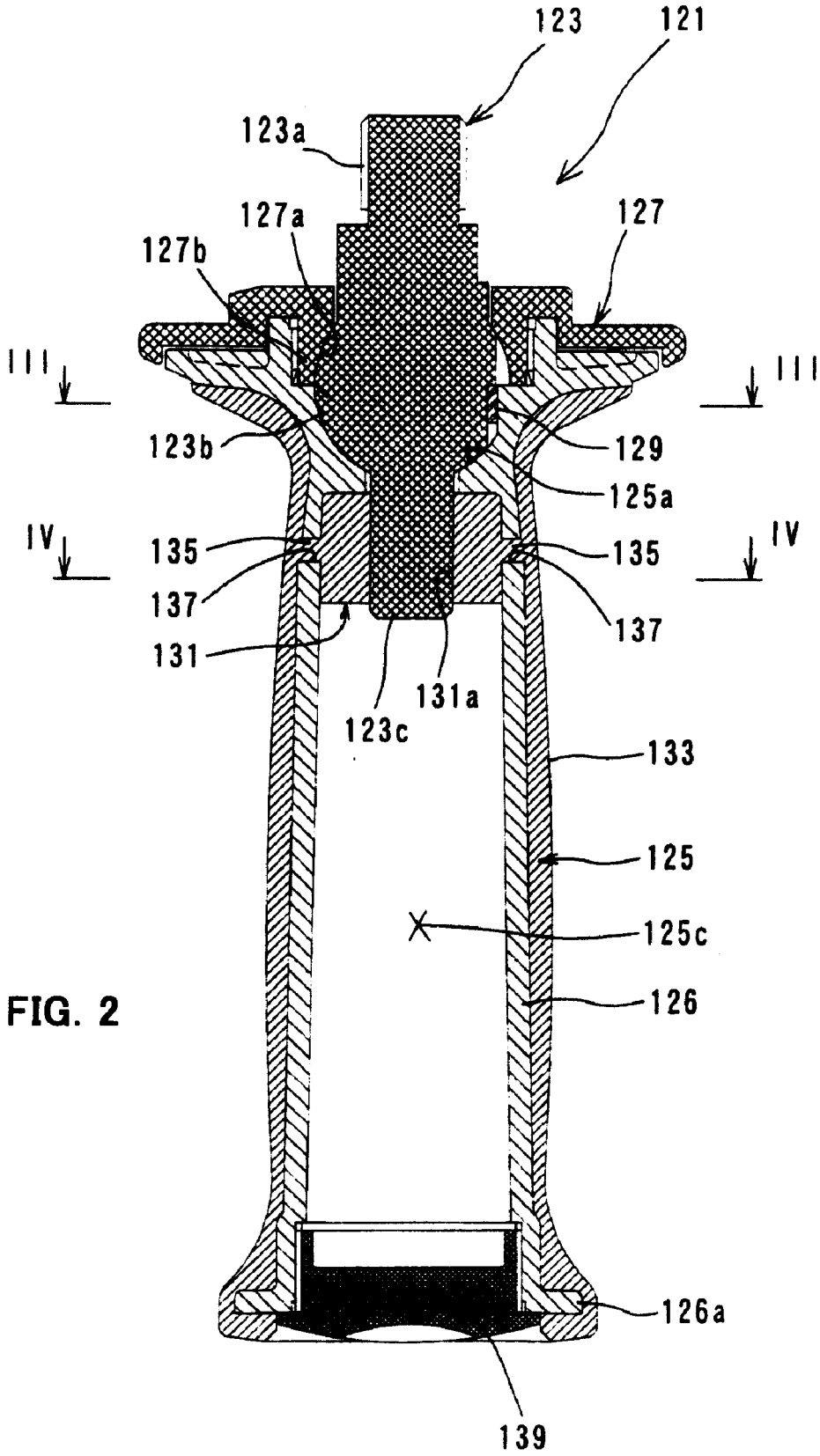
FIG. 2 is a sectional view of the auxiliary handle.

A first representative embodiment of the invention will now be described with reference to FIGS. 1 to 4. The representative embodiment is explained as to a vibration-proof handle when applied as an auxiliary handle for operating an electric disc grinder 101. FIG. 1 shows the entire auxiliary handle attached to the electric disc grinder, in section FIG. 2 shows only the auxiliary handle in section. FIGS. 3 and 4 are sectional views taken along line III-III and line IV-IV in FIG. 2. The electric disc grinder 101 will be briefly explained with reference to FIG. 1. The electric disc grinder 101 comprises a body 103 that includes a motor housing 105 and a gear housing 107. The body 103 is a feature that corresponds to the "tool body" according to the invention. The motor housing 105 is generally cylindrically formed and houses a driving motor 111. The driving motor 111 is arranged such that the direction of the axis of rotation coincides with the longitudinal direction of the disc grinder 101.

A power transmitting mechanism 113 is disposed within the gear housing 107 coupled to the front end of the motor housing 105 to transmit the rotating output of the driving motor 111 to a tool bit defined as a grinding wheel 115. The rotating output of the driving motor 111 is transmitted to the grinding wheel 115 as rotation in the circumferential direction via the power transmitting mechanism 113. The grinding wheel 115 is disposed on the forward part of the disc grinder 101 in the longitudinal direction such that the axis of its rotation is perpendicular to the longitudinal direction of the disc grinder 101 (the axis of rotation of the driving motor 111). Further, a main handle 109 is coupled to the rear end of the motor housing 105, and an auxiliary handle 121 is removably mounted to the side of the gear housing 107. The main handle 109 is disposed such that the longitudinal direction of the main handle 109 coincides with the longitudinal direction of the disc grinder 101, while the auxiliary handle 121 is disposed such that the longitudinal direction of the auxiliary handle 121 is perpendicular to the longitudinal direction of the main handle 109. User holds the both handles 109 and 121 by hands when grinding a workpiece.

Next, the structure of the auxiliary handle 121 is explained with reference to FIGS. 2 to 4. The auxiliary handle 121 includes a generally cylindrical handle body 123 and a cylindrical grip 125 held by the user. The handle body 123 is removably mounted to a handle mounting portion 107*a* formed on the side of the gear housing 107. The handle mounting portion 107*a* comprises a threaded mounting hole of which axis extends perpendicularly to the longitudinal direction of the body 103.

The handle body 123 has a generally cylindrical shape which includes a threaded mounting portion 123*a* on one end (upper end as viewed in FIG. 2) in the longitudinal direction of the handle body 123, a spherical portion 123*b* in the middle and an engaging shank 123*c* on the other end, all of which are formed in one piece continuously in the axial direction. The handle body 123 is inserted into the cylindrical grip 125 and the spherical portion 123*b* is engaged with a spherical concave surface 125*a* that is formed on one end (upper end as viewed in FIG. 2) of the grip 125 in the longitudinal direction and with a spherical concave surface 127*a* that is formed in an end plate 127.

Thus, the grip 125 can be rotated at one longitudinal end around the center of the spherical portion 123*b* in all directions with respect to the handle body 123. The end plate 127 includes a cylindrical portion 127*b* having the concave surface 127*a* in the inner surface and a threaded portion on the outer surface. The end plate 127 is fixed to the grip 125 by screwing the cylindrical portion 127*b* into the threaded hole of the grip 125.

Further, as shown in FIG. 3 in section, a pair of flat surface portions 123*d* are formed in the spherical portion 123*b* of the handle body 123 parallel to each other on the both sides of the axis of the handle body 123. Correspondingly, a pair of flat surface portions 125*b* are formed on the both sides of the axis of the handle body 123. A sheet-like rubber elastic plate 129 is disposed between the opposed flat surface portions 123*d* and 125*b* and serves to absorb rattling which may be caused by a manufacturing error between the handle body 123 and the grip 125.

As shown in FIGS. 2 and 4, the engaging shank 123*c* on the other end of the handle body 123 is circular in section and extends into a bore 125*c* of the grip 125 through the center of the concave surface 125*a* of the grip 125. A generally ring-like shaped rubber isolator 131 is disposed within the bore 125*c* of the grip 125 between the inner surface of the bore 125*c* and the outer surface of the engaging shank 123*c*. The rubber isolator 131 is a feature that corresponds to the "elastic element" according to the invention. An axially extending engaging hole 131*a* is formed through the center of the rubber isolator 125*c*. The engaging shank 123*c* is tightly fitted into the engaging hole 131*a*. The rubber isolator 131 serves to absorb vibration transmitted from the handle body 123 to the grip 125. Specifically, the rubber isolator 131 applies a biasing force to the grip 125 mainly in the radial direction between the grip 125 and the handle body 123 when the grip 125 rotates on the spherical portion 123*b* of the handle body 123 with respect to the handle body 123.

The grip 125 mainly comprises a cylindrical body 126 made of a rigid resin material. The outer surface of the cylindrical body 126 is generally entirely covered with a rubber elastic cover 133. The elastic cover 133 is a feature that commands to the "elastic outer member" according to the mention. The elastic cover 133 is connected, via a plurality of connecting portions 135, to the rubber isolator 131 disposed within the bore 125*c* of the grip 125 (the bore of the cylindrical body 126). Specifically, the elastic cover 133 and the rubber isolator 131 are integrally formed with each other via the connecting portions 135. The connecting portions 135 extend through a plurality of through holes 137 of the cylindrical body 126. As shown in FIG. 4, the through holes 137 (two in the drawing) are formed through the cylindrical body 126 at appropriate intervals in the circumferential direction and extend through the cylindrical body 126 in the radial directions perpendicular to the axial diction of the cylindrical body 126.

The elastic cover 133 and the rubber isolator 131 are formed using a mold, for example, by insert molding. Specifically, in order to form the elastic cover 133 and the rubber isolator 131, the cylindrical body 126 is placed within the mold formed into a predetermined shape and then, the mold is charged with liquid rubber. The elastic cover 133 and the rubber isolator 131 are formed by solidification of the liquid rubber. By this molding, the connecting portions 135 are formed within the through holes 137 of the cylindrical body 126 and connect the elastic cover 133 and the rubber isolator 131. In this manner, the grip 125 is formed as one part in which the elastic cover 133 and the rubber isolator 131 are fixed (joined) to the cylindrical body 126. A flange 126*a* is formed on the other axial end (lower end as viewed in FIG. 2) of the cylindrical body 126 and projects outward. The elastic cover 133 wraps the flange 126*a* and is thus prevented from separating from the cylindrical body 126. Further, the bore 125*c* of the cylindrical body 126 is closed by a cap 139.

The auxiliary handle 121 according to this embodiment is constructed as mentioned above and mounted in use to the disc grinder 101 as shown in FIG. 1. The auxiliary handle 121 is mounted to the disc grinder 101 by screwing the threaded mounting portion 123*a* of the handle body 123 into the handle mounting portion (threaded mounting hole) 107*a* formed in the body 103 of the disc grinder 101. With the auxiliary handle 121 according to this embodiment, if vibration is caused during the grinding operation by the disc grinder 101, such vibration is absorbed by the vibration absorbing function of the rubber isolator 131 when the vibration is transmitted from the body 103 to the grip 125 via the handle body 123 of the auxiliary handle 121. Thus, vibration of the grip 125 can be reduced. The grip 125 can be rotated in all directions with respect to the handle body 123 via the spherical surface. Therefore, the vibration absorbing function can be unerringly performed with respect to vibration transmitted to the grip 125 from varying directions and as a result, the auxiliary handle 121 provides ease of use. Further, with the construction in which the grip 125 can be rotated in all directions via the spherical surface, no limitation is imposed in the directions of mounting the handle to the body 103. Thus, a simple, low-cost mounting construction can be adopted in which the threaded mount portion 123*a* is screwed into the handle mounting portion 107*a*.

In order to assemble the auxiliary handle 121 according to this embodiment, the handle body 123 is inserted from the engaging shank 123*c* into the grip 125 though one end of the grip 125. The end plate 127 is then placed over the end of the grip 125 and the cylindrical portion 127*b* of the end plate 127 is screwed into the threaded hole of the grip 125. At this time, the engaging shank 123*c* of the handle body 123 is tightly fitted into the engaging hole 131*a* of the rubber isolator 131. Thus, the rubber isolator 131 is disposed between the inner surface of the bore 125*c* and the outer surface of the engaging shank 123*c*.

In the process of manufacturing the grip 125, the rubber isolator 131 is integrally formed with the elastic cover 133 that covers the outer surface of the grip 125. In other words, the grip 125 is formed as one part in which the elastic cover 133 and the rubber isolator 131 are fixed to the cylindrical body 126. Therefore, the process of mounting the rubber isolator 131 to the grip 125 is not required. Thus, the number of man-hours needed to assemble the auxiliary handle 121 can be reduced compared with a construction which requires the process of mounting a rubber isolator as part of the operation of assembling an auxiliary handle. Thus, ease of assembly can be enhanced.

Further, the grip 125 can be formed by using only one mold because the elastic cover 133 and the rubber isolator 131 are formed in one piece. Therefore, compared with the case in which a rubber isolator and a grip are separately formed and hereafter assembled together, the number of molds and thus the number of man-hours can be reduced, so that the manufacturing costs can be reduced Further, because the elastic cover 133 on the outside of the grip 125 is connected to the rubber isolator 131 disposed inside the grip 125, via the connecting portions 135 that extend through the cylindrical body 126, the position of the rubber isolator 131 can be freely changed in the axial direction of the grip 125 by changing the position of the connecting portions 135. The rubber isolator 131 is located near the center of rotation of the grip 125 and by such placement of the rubber isolator 131, the engaging shank 123*c* of the handle body 123 can be shorter so that the weight of the handle body 123 can be reduced. Further, the thinner region of the cylindrical body 126 can be longer in the axial length, so that the weight of the cylindrical body 126 can be reduced. On the other hand, the position of the rubber isolator 131 can be changed to a position remote from the center of rotation of the grip 125 or to a position nearer to the cap 139 (on the lower side as viewed in FIG. 2). In this position, the vibration amplitude is at the maximum. Therefore, by this place of the rubber isolator 131, vibration can be efficiently absorbed.

Further, when the handle body 123 is inserted into the grip 125 to mount the handle body 123 to the grip 125, the engaging shank 123*c* is inserted into the engaging hole 131*a* of the rubber isolator 131. Thus, the handle body 123 can be efficiently mounted to the grip 125. Further, when the engaging shank 123*c* is inserted into the engaging hole 131*a* of the rubber isolator 131 or when the engaging shank 123*c* is tightly fitted into the rubber isolator 131, the force of pressing the rubber isolator 131 in the axial direction acts on the rubber isolator 131. Because the rubber isolator 131 is connected to the elastic cover 133 via the connecting portions 135 that extend radially through the cylindrical body 126, the connecting portions 135 serve to prevent the axial movement of the rubber isolator 131. Thus, the rubber isolator 131 can be retained in a predetermined position so that the fit between the rubber isolator 131 and the engaging shank 123*c* can be insured. Further, the connecting portions 135 serve to prevent the elastic cover 133 of the grip 125 from separating from the cylindrical body 126. Specifically, the connecting portions 135 provide for the prevention of separation of the elastic cover 133 from the outer surface of the cylindrical body 126. Thus, the quality of the grip 125 can be maintained.

Further, the grip 125 is coupled to the handle body 123 such that it can be rotated in all directions via the spherical portion 123*b* with respect to the handle body 123. However, it may be constructed such that the grip 125 is rotated with respect to the handle body 123 on a plurality of pivots crossing with each other, or on a single pivot.

Further, while the electric disc grinder 101 is described as a representative example of application of the auxiliary handle 121, the auxiliary handle 121 may also be applied to a rotary power tool such as a polisher, a circular saw and a vibrating drill, which performs an operation on a workpiece by rotation of a tool bit. Further, it may also be applied to an impact power tool such as an electric hammer and a hammer drill, which performs fracturing or drilling operation on a workpiece by causing a tool bit to perform hammering movement in the axial direction or the hammering movement and rotation in combination. Moreover, it may also be applied to cutting tools such as a reciprocating saw or a jig saw, which perform a cutting operation on a workpiece by causing a blade to perform a reciprocating movement, whereby causing a substantially linear vibration.

Further, it may be constructed such that the rubber isolator 131 is disposed on the free end of the grip 125 and also serves as the cap 139 to close the bore 125*c* of the grip 125. In this case, the connecting portions 135 for connecting the rubber isolator 131 and the elastic cover 133 may be arranged to cover the axial end surface of the cylindrical body 126, instead of extending through the cylindrical body 126. Further, the elastic cover 133 and the rubber isolator 131 may be formed into one piece and thereafter fitted over the cylindrical body 126. Further, while a plurality of the through holes 137 are formed through the cylindrical body 126 of the grip 125, one through hole 137 may be provided instead.

SECOND REPRESENTATIVE EMBODIMENT

Figure 5:
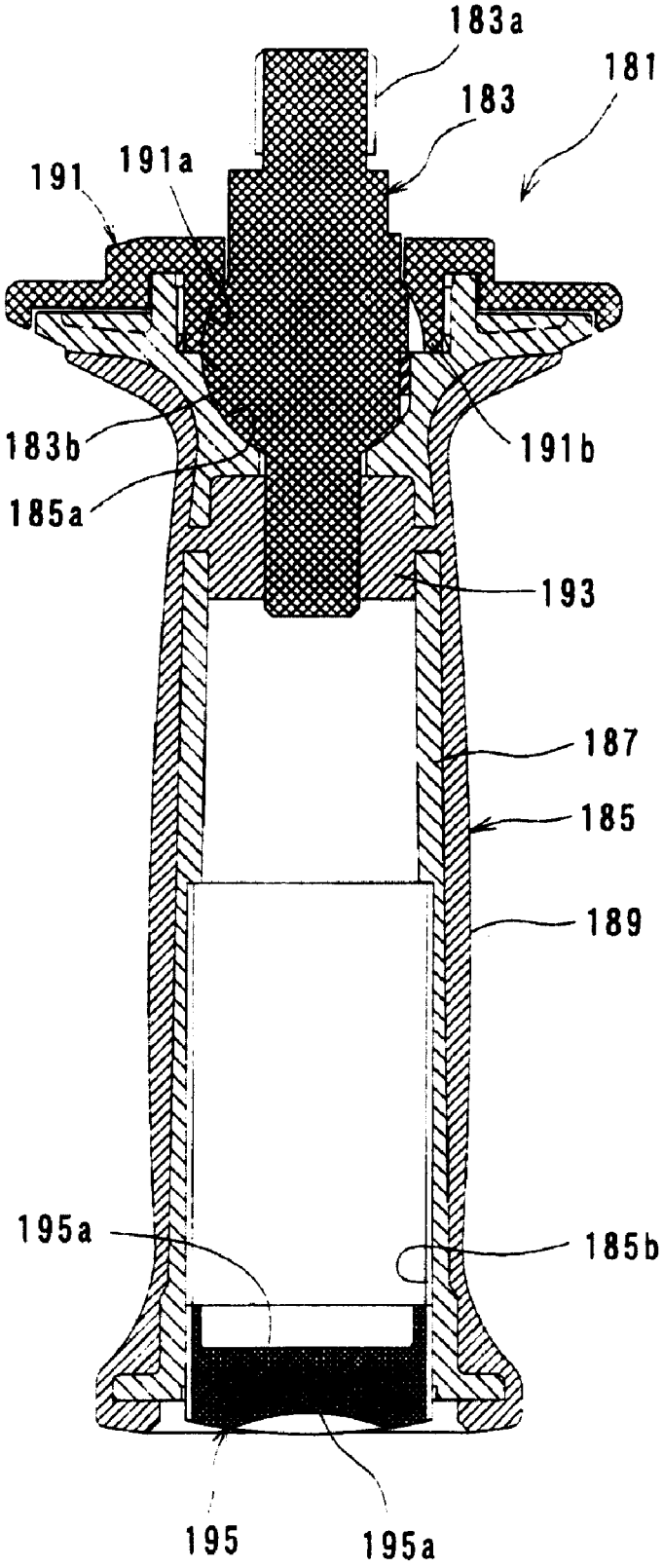
FIG. 5 is a longitudinal section showing a vibration-proof handle according to a second embodiment of the invention.
Figure 6:
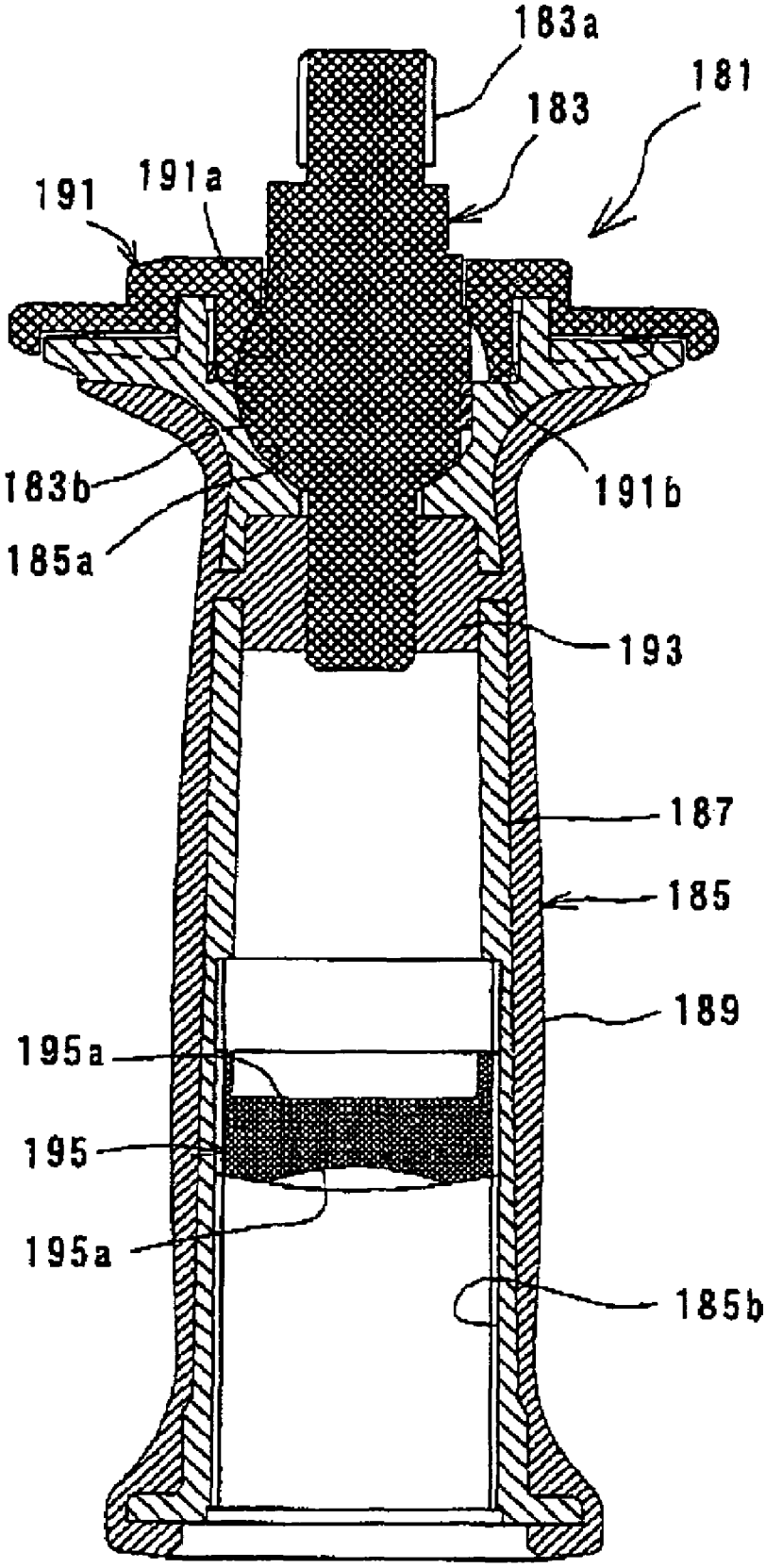
FIG. 6 is a longitudinal section showing the vibration-proof handle according to the second embodiment, with a weight shown mounted in a different position.

A handle according to a second representative embodiment of the invention is described with reference to FIGS. 5 and 6. The representative handle is defined as a vibration-proof handle and includes a handle body in the form of a generally cylindrical mounting rod 183 and a grip 185 held by the user. The mounting rod 183 can be mounted to a body of a power tool (not shown), such as an electric grinder. The mounting rod 183 includes a threaded mounting portion 183*a* formed on one end (upper end as viewed in FIG. 5) in its longitudinal direction, and a spherical portion 183*b*. The mounting rod 183 is inserted into the cylindrical grip 185 and the spherical portion 183*b* is engaged with a spherical concave surface 185*a* that is formed on one end (upper end as viewed in FIG. 2) of the grip 185 in the longitudinal direction and with a spherical concave surface 191*a* that is formed in an end plate 191. Thus, the grip 185 can be rotated at one longitudinal end around the center of the spherical portion 183*b* in all directions with respect to the mounting rod 183. The end plate 191 includes a cylindrical portion 191*b* having the spherical surface 191*a* in the inner surface and a threaded portion on the outer surface. The end plate 191 is fixed to the grip 185 by screwing the cylindrical portion 191*b* into the threaded hole of the grip 185.

A cushion rubber 193 is disposed between the grip 185 and the mounting rod 183 on the other axial end portion of the mounting rod 183. The cushion rubber 193 is a feature that corresponds to the "elastic element" according to the invention and serves to absorb vibration transmitted from the mounting rod 183 to the grip 185. Specifically, the cushion rubber 193 applies a biasing force to the grip 185 in the radial direction between the grip 185 and the mounting rod 183 when the grip 185 rotates on the spherical portion 183*b* with respect to the mounting rod 183. The grip 185 includes a grip body or a cylindrical body 187 and a rubber cover 189 that generally entirely covers the outer surface of the cylindrical body 187. The cover 189 is integrally formed with the vibration absorbing cushion rubber 193.

A weight mounting portion 185*b* for mounting the weight 195 is formed in the other axial end portion (lower end portion as viewed in FIG. 2) of the grip 185. The weight mounting portion 185*b* comprises a hole threaded on the inner surface of the bore of the cylindrical body 187. The weight 195 comprise a cylindrical body having a male thread on the outer surface and can be removably mounted to the grip 185 by screwing into the threaded hole on the inner of the bore of the cylindrical body 187. The weight 195 is provided to change the position of the center of gravity of the grip 185 in the longitudinal on. As one manner of such change, a plurality of the weights 195 of predetermined different weights are prepared and then, one of the weights 195 is selected and mounted in the weight mounting portion 185*b*. The weight difference of the weights 195 is created, for example, by changing the materials (for example, by making a resin weight and a metal weight) or by changing the axial depth of a recess 195*a* of the weight 195. As another manner of changing the position of the center of gravity of the grip 185, the mounting position of the weight 195 within the weight mounting portion 185*b* can be adjusted. Specifically, the threaded hole in the form of the weight mounting portion 185*b* extends an elongated distance from the other end surface of the cylindrical body 187 generally to the middle in the longitudinal direction. Thus, the position of mounting the weight 195 within the weight mounting portion 185*b* can be changed, for example, from the position shown in FIG. 5 to the position shown in FIG. 6, by changing the depth of screwing the weight 195 into the weight mounting portion 185*b*. The weight 195 also serves as a cap to close the bore of the grip 185.

The natural frequency of the grip 185 can be changed, for example, by changing the rigidity or the mass of the grip 185. The weight 195 to be mounted in the weight mounting portion 185*b* of the grip 185 of the auxiliary handle 181 can be selectively changed from one to another of different weight. Further or otherwise, the position of mounting the weight 195 within the weight mounting portion 185*b* can be adjusted. The position of the center of gravity of the grip 185 can be changed in the longitudinal direction by weight change of the weight 195 or by adjustment of the mounting position of the weight 195. In other words, the distance between the center of gravity and the center of rotation of the grip 185 that rotates (vibrates) around the center of the spherical portion 183*b* of the mounting rod 183, can be changed. Such change of the position of the center of gravity causes change of the rotating moment around the center of rotation of the grip 185 which acts on the center of gravity of the grip 185. By such change of the rotating moment, the natural frequency of the grip 185 that rotates around the center of the spherical portion 183*b* can be changed.

For example, when the auxiliary handle 181 is mounted to an electric grinder, the weight 195 is arranged such that the natural frequency of the grip 185 is displaced to a lower value than the frequency of vibration caused during operation of the grinder. As a result, vibration of the grip 185 caused by transmission of vibration from the body of the grinder to the grip 185 can be effectively reduced.

Generally, frequencies of vibration which is caused in a power tool and thus frequencies of vibration to be reduced vary by model or type of power tool. According to the representative auxiliary handle 181, the natural frequency of the grip 185 can be readily changed according to the model or the type of power tool to which the auxiliary handle 181 is mounted. In other words, one type of auxiliary handle 181 can be applied to different models or types of power tool. While the natural frequency of the grip 185 is changed by the manufacturer, such change can be made by the user of the grip 185.

The construction for mounting the weight 195 to the grip 185 is not limited to the type in which the weight 195 is screwed into the hole threaded on the inner surface of the bore of the grip 185. For example, the weight 195 may be fastened to the grip 185 by screws which are separately provided. Alternatively, an engaging claw may be provided on one of the inner surface of the bore of the grip 185 and the outer surface of the weight 195, and an engaging groove that can be engaged with the engaging claw may be provided on the other. The weight 195 is inserted into the bore of the grip 185 with the engaging claw and the engaging groove aligned with each other and then, the weight 195 is turned in the circumferential direction in such a manner as to prevent removal. Further, the weight 195 may be mounted on the outside of the grip 185.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

We claim:

1. A handle comprising:

a handle body that can be mounted to a power tool, a hollow grip into which the handle body is inserted, the grip being coupled to the inserted handle body such that the grip can move with respect to the handle body, an elastic element disposed between an inner surface of the grip and an outer surface of the handle body when viewed along a longitudinal axis of the handle, wherein the elastic element applies a biasing force to the grip upon movement of the grip with respect to the handle body when vibration of the power tool is transmitted from the handle body to the grip, an elastic outer surface member that covers the outer surface of the grip, the elastic outer surface member being integrally formed with the elastic element, and a through hole formed through the grip, the through hole extending in a direction crossing an axial direction of the grip, wherein the elastic element and the elastic outer surface member are connected to each other via a connecting portion that lies in the through hole.

2. The handle as defined in claim 1, wherein the elastic element is disposed within the grip outward of a position of mounting the handle body to the power tool.

3. The handle as defined in claim 1 further comprising a pivot section that couples the grip to the handle body, wherein the pivot section allows the grip to rotate with respect to the handle body when vibration of the power tool is transmitted from the handle body to the grip, and wherein the elastic element is disposed in a region outside the pivot section between the handle body and the grip and applies a biasing force to the grip upon rotation of the grip on the pivot with respect to the handle body when vibration of the power tool is transmitted from the handle body to the grip.

4. The handle as defined in claim 1, wherein the elastic element is disposed outward of a pivot section within the grip.

5. The handle as defined in claim 1, wherein the elastic element is fitted onto the outer surface of an inserted end of the handle body when the handle body is inserted into the grip in the axial direction in order to mount the handle body to the grip, and wherein the connecting portion prevents the elastic element to move in the axial direction.

6. The handle as defined in claim 1, wherein the grip is coupled to the handle body such that the grip can rotate in all directions with respect to the handle body, and wherein the elastic element applies a biasing force to the grip upon rotation of the grip in all directions with respect to the handle body.

7. The handle as defined in claim 6, wherein one of the grip and the handle body has a spherical portion and the other of the grip and the handle body has a concave portion that is complementary to the spherical portion, and wherein the grip is coupled to the handle body via the spherical portion and the concave portion such that the grip can be rotated in all directions with respect to the handle body.

8. The handle as defined in claim 1, wherein the handle body is selectively mounted to different kinds of power tools, and wherein the grip is adapted and arranged such that a natural frequency of the grip can be changed according to the kind of power tool to which the handle is mounted.

9. The handle as defined in claim 8 further comprising a pivot that connects the grip to the handle body, wherein the pivot allows the grip to rotate on the pivot with respect to the handle body when vibration of the power tool is transmitted from the handle body to the grip, and wherein a distance between the pivot and a center of gravity of the grip can be changed in the grip so that the natural frequency of the grip can be changed by changing said distance with the handle body mounted to the power tool.

10. The handle as defined in claim 8, wherein the change of the natural frequency of the grip can be made by at least one of selectively mounting at least one of weights of different kinds varying in weight or by adjusting a position of mounting the weight in the grip in a longitudinal direction of the grip.

11. A handle comprising:

a handle body designed to be selectively mounted to different kinds of power tools, a grip coupled to the handle body such that the grip can move with respect to the handle body, an elastic element disposed between the grip and the handle body when viewed along a longitudinal axis of the handle, the elastic element applying a biasing force to the grip upon movement of the grip with respect to the handle body, and a through hole formed through the grip, the through hole extending in a direction crossing an axial direction of the grip, wherein the elastic element and an elastic outer surface member are connected to each other via a connecting portion that lies in the through hole, wherein a natural frequency of the grip can be changed according to the kind of power tool to which the handle is mounted.

12. The handle as defined in claim 11 further comprising a pivot that connects the grip to the handle body, wherein the pivot allows the grip to rotate around the pivot with respect to the handle body when vibration of the power tool is transmitted from the handle body to the grip, and wherein a distance between the pivot and a center of gravity of the grip can be changed in the grip so that the natural frequency of the grip can be changed by changing said distance with the handle body mounted to the power tool.

13. The handle as defined in claim 11, wherein the natural frequency of the grip can be changed by at least one of selectively mounting at least one of weights of different kinds varying in weight or by adjusting a position of mounting the weight in the grip in a longitudinal direction of the grip.

14. A power tool comprising:

a tool body, a main handle and an auxiliary handle to operate the tool body, wherein the auxiliary handle comprising:

a handle body mounted to the tool body, a grip coupled to the handle body such that the grip can move with respect to the handle body and an elastic element disposed between the grip and the handle body when viewed along a longitudinal axis of the handle, the elastic element applying a biasing force to the grip upon movement of the grip with respect to the handle body, wherein a natural frequency of the grip can be changed such that the natural frequency of the grip is displaced from a frequency of vibration caused by the power tool when the auxiliary handle is mounted to the tool body, and a through hole formed through the grip, the through hole extending in a direction crossing an axial direction of the grip, wherein the elastic element and an elastic outer surface member are connected to each other via a connecting portion that lies in the through hole.

* * * * *